US005522193A

United States Patent [19]

Sommerstein et al.

[11] Patent Number: 5,522,193

[45] Date of Patent: Jun. 4, 1996

[54] PANEL MOUNTING ARRANGEMENT

[76] Inventors: Michael Sommerstein, 75 Green Acres Road, Thornhill, Ontario, Canada, L4J 4S2; Herbert F. Jenkinson, 25 Monterrey Drive, Rexdale, Ontario, Canada, M9V 1S7

[21] Appl. No.: 200,445

[22] Filed: Feb. 23, 1994

[51] Int. Cl.[6] ..... E04B 2/82; E04B 2/88

[52] U.S. Cl. ..... 52/235; 52/481.2; 52/483.1; 52/780; 52/781; 52/506.06; 52/508; 52/511; 52/763

[58] Field of Search ..... 52/235, 506.06, 52/506.08, 762–764, 775, 511, 780, 481.2, 506.03, 781, 483.1, 508

[56] References Cited

U.S. PATENT DOCUMENTS

| | | | |
|---|---|---|---|
| 2,048,981 | 7/1936 | Vass | 52/483.1 X |
| 2,053,482 | 9/1936 | Kellogg | 52/481.2 X |
| 2,128,797 | 8/1938 | Bohnsack | 52/481.2 |
| 2,994,413 | 8/1961 | Levy et al. | 52/491.2 X |
| 3,160,974 | 12/1964 | Carleton | 52/483.1 X |
| 4,064,664 | 12/1977 | Gaul | 52/235 X |
| 4,266,386 | 5/1981 | Bains | 52/481.2 |
| 4,309,858 | 1/1982 | Anderle | 52/506.08 X |

*Primary Examiner*—Robert J. Canfield
*Attorney, Agent, or Firm*—Ridout & Maybee

[57] ABSTRACT

In a simple and robust panel mounting arrangement support pins project laterally and inwardly from rearwardly projecting flanges at opposed side edges of a panel, and are operatively engaged within angled slots extending rearwardly from front edges of flanges of supports, thereby to support the side edges of the panel. Each slot has a first limb portion which is open at the front edge of the respective flange and extends rearwardly therefrom, and a second limb portion which communicates with the first limb portion of the slot and which entends downwardly to a closed end thereof at which the associated support pin is disposed when the panel is fully mounted on the support.

10 Claims, 5 Drawing Sheets

PANEL MOUNTING ARRANGEMENT

This invention relates to a panel mounting arrangement by which an exterior cladding panel for a building structure may be mounted on a support secured, directly or indirectly, to a structural member of the building structure, and it is a primary object of the present invention to provide such a panel mounting arrangement which is of simple and robust form and by which the panel may be manually mounted on and, if required, subsequently dismounted from the support without requiring the use of any special tools.

In accordance with the invention there is provided a panel mounting arrangement comprising a panel having opposed side edges, and a support for supporting each opposed side edge of the panel. At least one support pin projects laterally from each opposed side edge of the panel, with each support comprising a flange having a front edge, and at least one angled slot which is provided in the flange and which comprises a first limb portion which is open at the front edge of the flange and which extends rearwardly thereof, and a second limb portion which has an upper end communicating with the first limb portion and a closed lower end with the second limb portion extending downwardly from the upper end to the closed lower end thereof. The support pin is adapted to be inserted along the first limb portion of the slot from the open front end thereof, and along the second limb portion of the slot to the closed lower end thereof for supporting the respective side edge of the panel by the support.

In order that the invention may be more clearly understood and more readily carried into effect the same will now, by way of example, be more fully described with reference to the accompanying drawings in which FIG. 1 is a perspective view of a panel mounting arrangement accordingly to a preferred embodiment of the invention;

Figure 1:
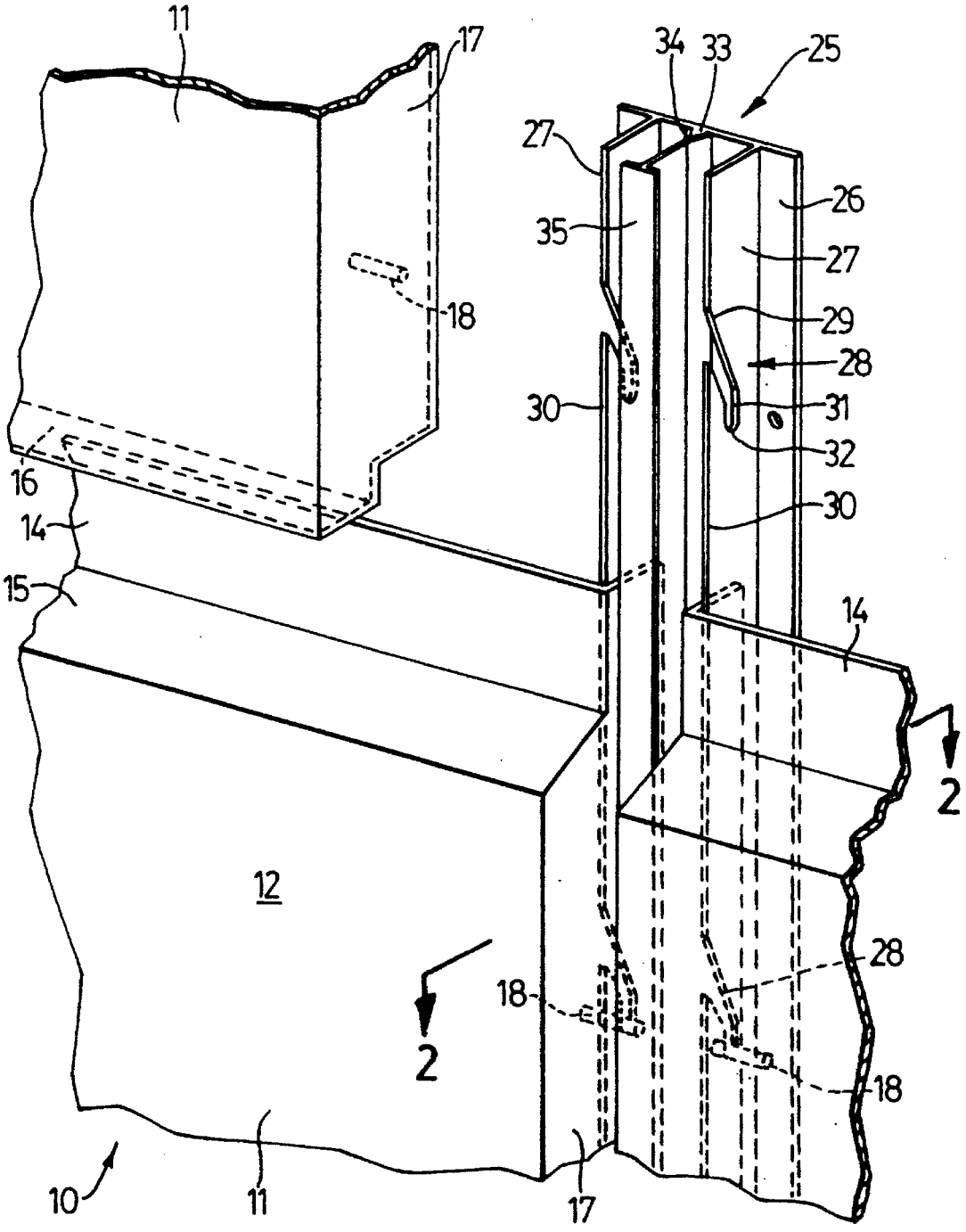
Figure 2:
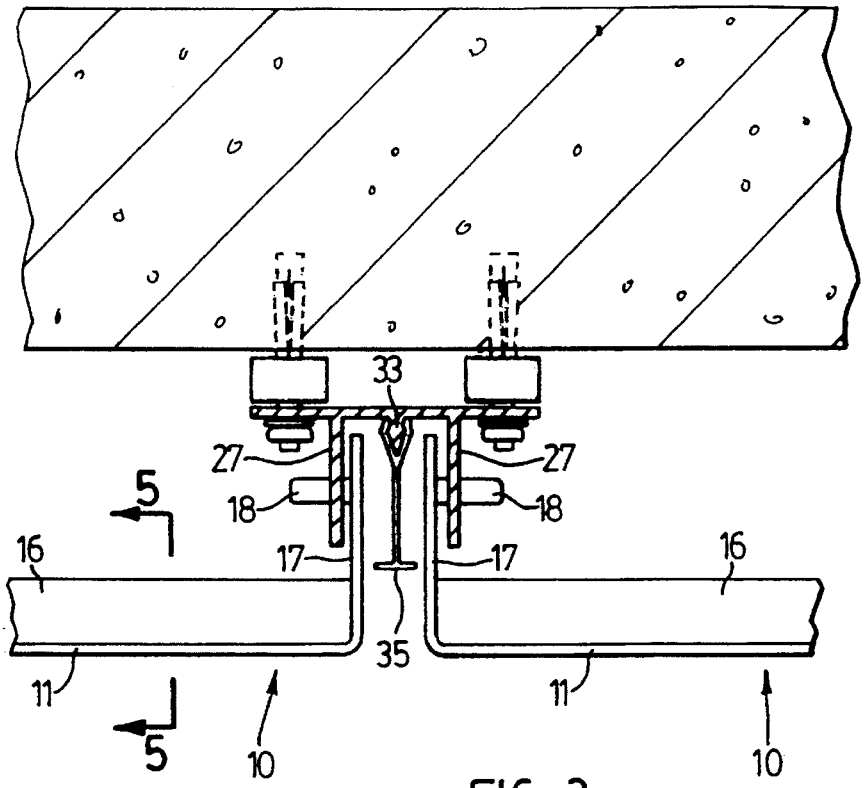
FIG. 2 is a sectioned view on the line 2—2 in FIG. 1.
Figure 3:
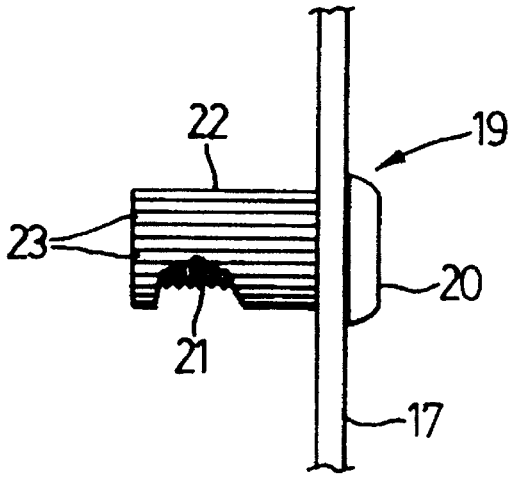
FIG. 3 is a view, on an enlarged scale, of a portion of the panel mounting arrangement shown in FIGS. 1 and 2, but in accordance with an alternative embodiment of the invention.
Figure 4:
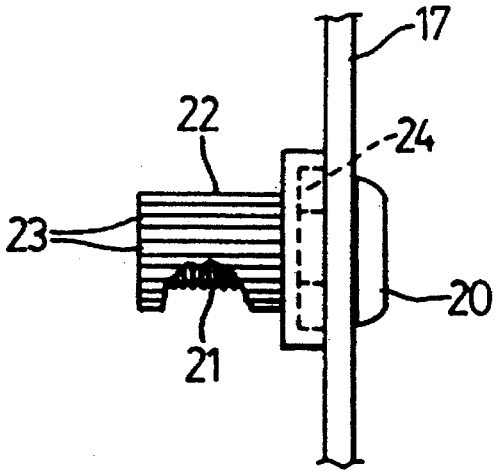
FIG. 4 is a view corresponding to FIG. 3, but in accordance with a further embodiment of the invention.

Referring to the drawings, 10 denotes each of a plurality of panels which, with particular reference to the embodiment shown in FIG. 1, is of aluminum sheeting which is formed and bent to provide a main panel wall 11 having a front face 12 and a rear face 13, an upper flange 14 connected to the main wall 11 by an inclined portion 15, a rearwardly extending lower flange 16, and rearwardly extending side flanges 17 at the opposed side edges of the panel 10, the ends of the flange 14 and of the inclined portion 15 being secured as by welding to the side flanges 17, and the ends of the lower flange 16 likewise being secured as by welding to the side flanges 17. Each panel 10 may alternatively be, for example, of porcelain coated metal sheeting. At least one and preferably a plurality of, say, three spaced support pins 18 project laterally in an inward direction relative to the panel 10 from each side flange 17 of the panel 10, each of these support pins 18 comprising, in the embodiment shown in FIG. 1, a cylindrical metal pin secured as by welding to the respective side flange 17 of the panel 10, although in the alternative embodiment shown in FIG. 3 each support pin 18 comprises a bolt 19 having a head 20 on the outer face of the respective side flange 17 of the panel 10, and a threaded shank 21 disposed through and projecting laterally from the respective side flange 17 with an internally threaded sleeve 22 of resiliently deformable material, such as nylon, being threadedly mounted on the shank 21. The cylindrical outer surface of the sleeve 22 has a plurality of circumferentially spaced, longitudinally extending grooves 23. The support pin 18 according to the further alternative embodiment shown in FIG. 4 differs from that hereinbefore described with reference to FIG. 3 in that a nut 24 is threadedly mounted on the shank 21 of the bolt 19 thereby to secure the bolt 19 to the respective side flange 17 of the panel 10, and the resiliently deformable sleeve 22 is a force fit on the shank 21 instead of being threadedly mounted thereon, and also covers the nut 24.

With further reference to FIG. 1, a support 25 is adapted to be secured as, for example, by bolting either directly, or indirectly by way of a spacer member or members (not shown), to a structural member of a building structure. The support 25 which is preferably of extruded form comprises a rear plate 26, and horizontally spaced, parallel flanges 27 which project forwardly from the rear plate 26. In each flange 27 is at least one angled slot 28, with the number of slots 28 corresponding to the number of support pins 18 presented by the respective side flange 17 of the panel 10 to be mounted on the portion in question of the support 25. Furthermore, where there is a plurality of spaced support pins 18 presented by said respective side flange 17 of the panel 10 the spacing between the slots 28 corresponds to the spacing between the support pins 18. Each slot 28 comprises a first limb portion 29 which is open at the front edge 30 of the associated flange 27 and which extends rearwardly thereof, and a second limb portion 31 which has an upper end communicating with the first limb portion 29 and a closed lower end 32. This second limb portion 31 extends downwardly from the upper end to the closed lower end 32 thereof. While the first limb portion 29 of the slot 28 is shown as being downwardly inclined in the rearward direction from the front edge 30 of the flange 27, this first limb portion 29 of the slot 28 may alternatively be substantially horizontal.

Between the flanges 27 the rear plate 25 also presents a forwardly projecting portion 33 over which a bifurcated rear edge portion 34 of a T-shaped member 35 may be snapped, thereby substantially to close the space between the adjacent side flanges 17 of adjacent panels 10 mounted on the support 25 and thus enhance the appearance of the arrangement.

Figure 8:
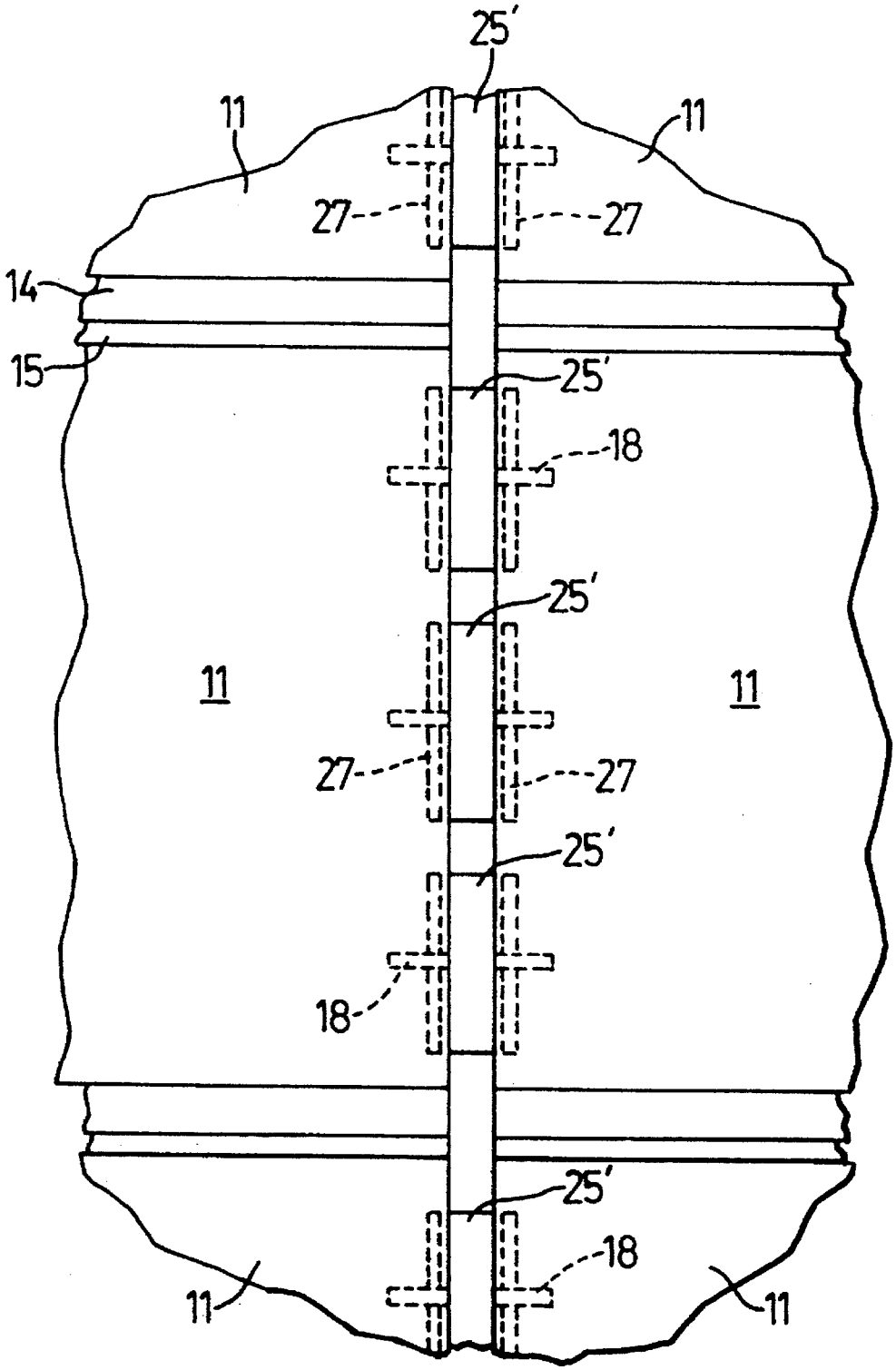
FIG. 8 is a front view, on a reduced scale, of a yet still further embodiment of the panel mounting arrangement shown in FIGS. 1 and 2.

It will of course be appreciated that, as shown in FIG. 8, each support 25 may be constituted by a plurality of vertically spaced support members 25, with each flange 27 of each such support member 25 having only one slot 28 therein.

Figure 6:
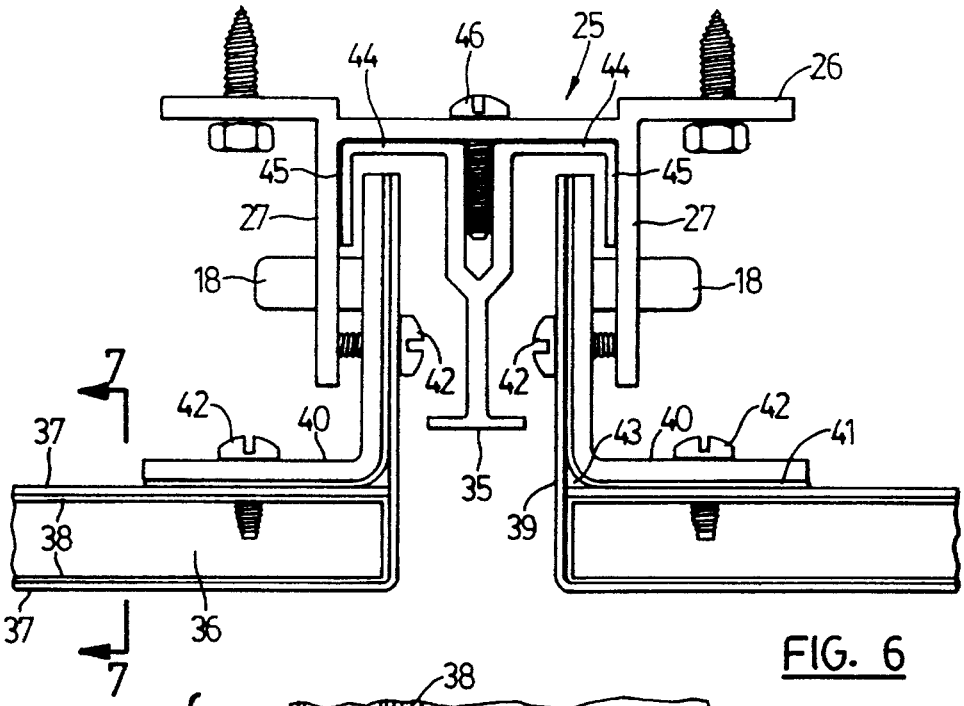
FIG. 6 is a view corresponding to FIG. 2, but of a still further alternative embodiment of the invention.
Figure 7:
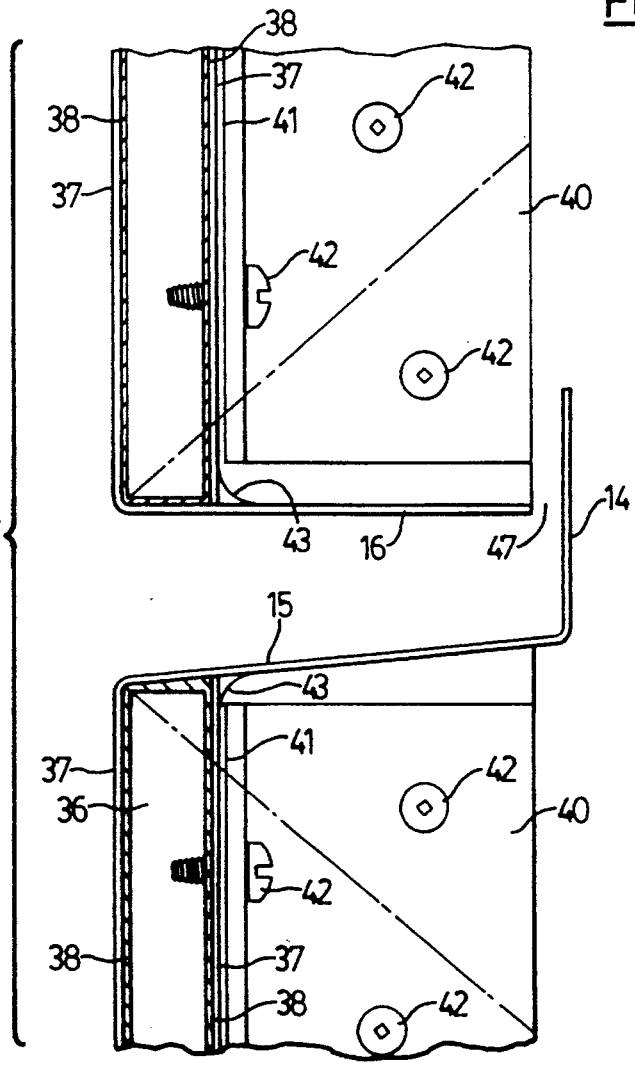
FIG. 7 is a sectioned view, corresponding to FIG. 5, but on the line 7—7 in FIG. 6.

With particular reference to the still further alternative embodiment shown in FIGS. 6 and 7 of the drawings, each panel 10 comprises a core board 36 with metal sheeting 37 of, for example, aluminum being bonded by a suitable adhesive 38 to front and rear faces of the core board 36, rearwardly extending side flanges 39 being presented by the metal sheeting 37 on the front face of the core board 36, and angled reinforcement members 40 which present the support pins 18 being bonded by a suitable adhesive 41 to these side flanges 39 and the adjacent portions of the metal sheeting 37 on the rear face of the core board 36, and being further secured thereto by screws 42. A silicone bead 43 is preferably provided around the entire peripheral edge of the metal sheeting 37 on the rear face of the core board 36 substantially to prevent the ingress of any moisture into the core board 36.

In this alternative embodiment shown in FIGS. 6 and 7, the bifurcated rear edge portion 34 of the T-shaped member 35 has extended leg portions 44 and 45 which overlie the inner face of the rear plate 26 and the inner faces of the flanges 27, respectively, and instead of the member 33 there is provided a plurality of screws 46 which are disposed through the rear plate 26 of the support 25 and are threadedly engaged within the bifurcated rear edge portion 34 of the T-shaped member 35 thereby operatively to secure this member 35 in position.

It will be appreciated from the foregoing description that, in relation to all of the above-described embodiments of the invention, each side edge of each panel 10 is operatively mounted on the respective support 25 by inserting the support pins 18 through the open front ends of the first limb portions 29 of the respective slots 28 and then disposing the panel 10 such that each support pin 18 is moved along the first limb portion 29 of the respective slot 28 and along the second limb portion 31 to the closed lower end 32 thereof, the panel 10 overlying the front edge 30 of the respective flange 27 of each associated support 25. The closed lower end 32 of the second limb portion 31 of the slot 28 and the support pin 18 preferably first having applied thereto generous coatings of silicone thereby substantially to prevent any rattling of the support pin 18 within the slot 28, although where the support pins 18 are in accordance with the alternative embodiments shown in FIGS. 3 and 4 these coatings of silicone may be omitted since the sleeve 22 of resiliently deformable material is, in these alternative embodiments, of such dimensions that the edges of the slot 28 at the closed lower end 32 of the second limb portion 31 thereof bite into the sleeve 22 so that at this closed lower end 32 of the second limb portion 31 the sleeve is an interference fit. Rattling of the support pin 18 within the slot 28 is thus substantially prevented. The grooves 23 in the outer cylindrical surface of the sleeve 22 serve to facilitate such biting of the edges of the second limb portion 31 of the slot 28 at the closed lower end 32 thereof into the outer cylindrical surface of the sleeve 22.

Figure 5:
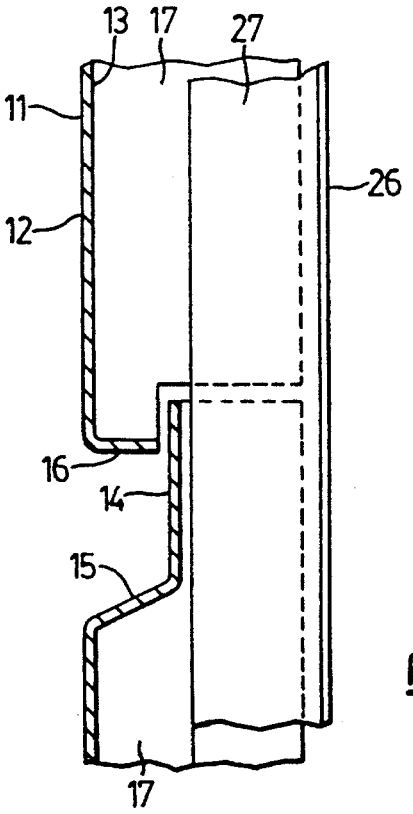
FIG. 5 is a sectioned view on the line 5—5 in FIG. 2.

The lowermost panels 10 are first mounted on the supports 25, and then the next lowermost panels 10 are so mounted, and so on, the space 47 shown in FIGS. 5 and 7 between the upper flange 14 of each panel 10 and the lower flange 16 of the panel 10 disposed immediately thereabove serving to permit drainage of any moisture which might otherwise accumulate on the lower flange 16 of each panel 10.

If desired, each of the panels 10 may, of course, subsequently be removed from the support 25 by performing each of the above-described operations in reverse and in the reverse sequence.

We claim:

1. A panel mounting arrangement comprising a panel having opposed side edges, and supports each of which is for supporting a respective opposed side edge of the panel, at least one support pin projecting laterally from each opposed side edge of the panel, with each support comprising a flange having a front edge, and at least one angled slot being provided in the flange and comprising a first limb portion which has an open front end at the front edge of the flange and which extends rearwardly thereof and is downwardly inclined therefrom, and a second limb portion which has an upper end communicating with the first limb portion and a closed lower end with the second limb portion extending downwardly from the upper end to the closed lower end thereof, whereby a support pin is adapted to be inserted along the first limb portion of the slot from the open front end thereof, and along the second limb portion of the slot to the closed lower end thereof for supporting the respective side edge of the panel by the support.

2. A panel mounting arrangement comprising a panel having opposed side edges, and supports each of which is for supporting a respective opposed side edge of the panel and comprises a plurality of vertically spaced support members, a plurality of spaced support pins projecting laterally from each opposed side edge of the panel, with each support member comprising a flange having a front edge, and a corresponding plurality of correspondingly spaced angled slots being provided one in the flange of each support member of the respective support with each slot comprising a first limb portion which has an open front end at the front edge of the flange and which extends rearwardly thereof, and downwardly inclined therefrom, and a second limb portion which has an upper end communicating with the first limb portion and a closed lower end with the second limb portion extending downwardly from the upper end to the closed lower end thereof, whereby each support pin is adapted to be inserted along the first limb portion of the respective slot from the open front end thereof, and along the second limb portion of the said respective slot to the closed lower end thereof for supporting the respective side edge of the panel by the support.

3. A panel mounting arrangement comprising a panel having opposed side edges, and supports each of which is for supporting a respective opposed side edge of the panel, at least one support pin which comprises a bolt having a shank projecting laterally from each opposed side edge of the panel, and a resiliently deformable sleeve mounted on the shank of the bolt, with each support comprising a flange having a front edge, at least one angled slot being provided in the flange, with the resiliently deformable sleeve being adapted for an interference fit in the slot, and the slot comprising a first limb portion which has an open front end at the front edge of the flange and which extends rearwardly thereof, and a second limb portion which has an upper end communicating with the first limb portion and a closed lower end with the second limb portion extending downwardly from the upper end to the closed lower end thereof, whereby a support pin is adapted to be inserted along the first limb portion of the slot from the open front end thereof, and along the second limb portion of the slot to the closed lower end thereof for supporting the respective side edge of the panel by the support.

4. A panel mounting arrangement according to claim 3, wherein the resiliently deformable sleeve has an outer cylindrical surface, and circumferentially spaced grooves are provided in the outer cylindrical surface of the resiliently deformable sleeve.

5. A panel mounting arrangement according to claim 3, wherein the resiliently deformable sleeve is of nylon.

6. A panel mounting arrangement according to claim 3, wherein the resiliently deformable sleeve is threadedly mounted on the shank of the bolt.

7. A panel mounting arrangement according to claim 3, wherein the shank of the bolt is disposed through the respective side edge of the panel, with a nut threadedly mounted on the shank of the bolt securing the bolt to said side edge of the panel, the resiliently deformable sleeve covering the nut and the shank of the bolt.

8. A panel mounting arrangement comprising a panel having opposed side edges each of which comprises a rearwardly extending flange, and supports each of which is for supporting a respective opposed side edge of the panel, at least one support pin projecting laterally from each opposed side edge of the panel and in an inward direction relative to the panel, with each support comprising a flange having a front edge, and at least one angled slot being provided in the flange and comprising a first limb portion which has an open front end at the front edge of the flange and which extends rearwardly thereof, and a second limb portion which has an upper end communicating with the first limb portion and a closed lower end with the second limb portion extending downwardly from the upper end to the closed lower end thereof, whereby a support pin is adapted to be inserted along the first limb portion of the slot from the open front end thereof, and along the second limb portion of the slot to the closed lower end thereof for supporting the respective side edge of the panel by the support with the panel overlying the front edge of the flange of the support.

9. A panel mounting arrangement according to claim 8, wherein the panel comprises a core board having front and rear faces, metal sheeting adhesively bonded on the front and rear faces of the core board, and angled reinforcement members secured on the rear face at the opposed side edges of the panel, with said at least one support pin at each opposed side edge of the panel being presented by the respective reinforcement member.

10. A panel mounting arrangement according to claim 8, wherein each support further comprises a further flange horizontally spaced from the first-mentioned flange for supporting a side edge of an adjacent panel, a T-shaped member being mounted between the flanges of the support.

* * * * *